US005629761A

United States Patent [19]

Theodoulou et al.

[11] Patent Number: 5,629,761

[45] Date of Patent: May 13, 1997

[54] TONER PRINT SYSTEM WITH HEATED INTERMEDIATE TRANSFER MEMBER

[76] Inventors: Sotos M. Theodoulou, 23 Greenmount Road, Bramlea, Ontario, Canada; Robert A. Moore, 6 Salt Hay Rd., Waquoit, Mass. 02536; Wojciech Zalewski, 3652 Bertand Road, Mississauga, Ontario, Canada, L4W 2S5

[21] Appl. No.: 435,517

[22] Filed: May 4, 1995

[51] Int. Cl.[6] ..... G03G 15/14; G03G 15/20

[52] U.S. Cl. ..... 399/307; 399/295

[58] Field of Search ..... 355/271, 277, 355/279, 326 R, 327; 118/645

[56] References Cited

U.S. PATENT DOCUMENTS

| | | | |
|---|---|---|---|
| 3,851,964 | 12/1974 | Smith et al. | 355/280 |
| 3,893,761 | 7/1975 | Buchan et al. | 355/279 X |
| 4,047,946 | 9/1977 | Croft | 96/1 |
| 4,057,016 | 11/1977 | Endo et al. | 101/465 |
| 4,453,820 | 6/1984 | Suzuki | 355/279 |
| 4,531,825 | 7/1985 | Miwa et al. | 355/279 |
| 4,542,978 | 9/1985 | Tarumi et al. | 355/279 |
| 4,657,373 | 4/1987 | Winthaegen et al. | 355/275 |
| 4,912,514 | 3/1990 | Mizutani | 355/272 |
| 4,927,727 | 5/1990 | Rimai et al. | 430/99 |
| 5,012,291 | 4/1991 | Buchan et al. | 355/271 |
| 5,103,263 | 4/1992 | Moore et al. | 355/271 X |
| 5,115,277 | 5/1992 | Camis | 355/273 |
| 5,150,161 | 9/1992 | Bujese | 355/256 |
| 5,187,526 | 2/1993 | Zaretsky | 355/273 |
| 5,208,638 | 5/1993 | Bujese et al. | 355/274 |
| 5,233,396 | 8/1993 | Simms et al. | 355/275 |
| 5,233,397 | 8/1993 | Till | 355/279 |
| 5,243,392 | 9/1993 | Berkes et al. | 355/275 |
| 5,253,023 | 10/1993 | Hosaka et al. | 355/279 |
| 5,276,492 | 1/1994 | Landa et al. | 355/277 |
| 5,293,537 | 3/1994 | Carrish | 355/285 |
| 5,303,014 | 4/1994 | Yu et al. | 355/273 |

*Primary Examiner*—William J. Royer

[57] ABSTRACT

In a printing system a first endless imaging member, such as a belt or drum, moves past an imaging station where it receives a dry toner image, and contacts a second endless imaging member to transfer the toner image to the second member. The first and the second imaging members are each operated isothermally with at least the second member at a temperature T2 higher than the softening temperature of the toner which, in turn, is above the temperature T1 of the first member. The first member has a hard abrasion-resistant and preferably smooth surface with a surface energy under about 20 dynes per centimeter, while the second member is both softer and has a higher surface energy, but still below that of the ultimate imaging substrate, e.g., paper, and has a thickness and compressibility that allow it to conform. In a preferred system, a charge-deposition cartridge deposits a latent charge image on a dielectric layer to attract and hold toner particles. A five micrometer thick surface layer of Teflon PFA simultaneously provides a suitable capacitance and low surface energy for the first member which is then developed with hard toner particles formed with a polymer having a softening temperature somewhat below the operating temperature T2 of the second imaging member. The second imaging member may be a belt having a woven Nomex carcass and an overlayer of silicone or fluorosilicone rubber elastomer having a Shore A hardness of approximately 50 to 80 durometer, to effect essentially complete image transfer between the first and second belts. In a multicolor system, separate imaging members for each color are successively brought into contact with and transfer their powder toner images in a softened state to a common transfer belt which applies the composite multicolor image to a final print.

14 Claims, 4 Drawing Sheets

TONER PRINT SYSTEM WITH HEATED INTERMEDIATE TRANSFER MEMBER

BACKGROUND OF THE INVENTION

The present invention relates to toner imaging systems of the type wherein a latent charge image is developed with a pigmented toner, and the developed image is transferred to a receiving member to make a printed image. There exist many technologies for forming a latent charge image, including optical image projection onto a charged photoconductive belt or drum; charging a dielectric member with an electrostatic pin array or electron beam; and charge projection from a so-called ionographic print cartridge or from a plasma generator. Once a latent image is formed, the latent image may be transferred to an intermediate member before development, or may be developed on the same member as that on which it is formed, with different system architectures having evolved to address different process priorities, such as cost, speed, preferred type of toning system or intended receiving substrate. The toner may be of a liquid-carried or a dry powder type; the former pose environmental concerns of solvent or carrier management, especially when printing on so-called plain, or bond, papers, while the latter developers raise concerns of dust control, especially as the toner particle size becomes finer. In either case, one must generally also address problems related to erasing or cleaning intermediate image carriers, and fixing the final image.

In general, the toned images, once transferred to a receiving member require heating to dry or fix the final image, but cannot endure heat at an earlier stage, when the toner is applied, as a dust or liquid suspension, to the latent charge image. Furthermore, at an even earlier stage, heating is generally also to be avoided on or near any photoconductive elements. Even for charge deposition systems in which an electric charge is applied to a dielectric rather than photoconductive member, heat may impair the dielectric properties of some common image-holding materials.

Thus, a complete imaging system often benefits from, and may require, having the image transferred one or more times before the final printing step in order to isolate the chemicals, temperatures or other environment of one imaging process station from those of another.

Another factor which has assumed prominence in imaging systems of the foregoing type is the heat transfer, or transfusing, of a toner image onto a final receiving substrate. In various prior art constructions, the toned image is simultaneously transferred to and fixed on the final member in a melted or fused state. It may further be necessary to control the precise temperature to vary the relative tackiness or the self-adherence of the heated toner, for example, in order to achieve optimal transfer of the image between rollers, or, when transferring to a final recording sheet, in order to optimize image reflectance properties. U.S. Pat. No. 3,554,836 of Steindorf describes a general approach useful in such multi-transfer systems. According to that patent, intermediate rollers may be formed of a silicone elastomer, and transfer is efficiently arranged between two successive image-carrying members by controlling the temperature of the colored image layer so that it is in a rubbery state, while the members have surfaces of silicone elastomer of increasing energy to enable relatively effective transfer of the heated image material from one roller to the next.

Nonetheless, the transfer of a toner image from one member to another remains highly dependent on the materials used, as well as on the characteristics of the transfer nip and the speed of contact, among other variables. When one or more of these variables is selected based on independent considerations, it may prove difficult to then achieve a suitable transfer speed or efficiency with the selected variable.

It would therefore be desirable to achieve a printing system in which transfer of a toned image is quickly and efficiently effected.

It would also be desirable to achieve such a printing system wherein multiple toned images are successively transferred to form a multicolor image.

SUMMARY OF THE INVENTION

These and other desirable properties are obtained in a printing system wherein a first endless imaging member, such as a belt or drum, moves past an imaging station where it receives a dry toner image, and contacts a second endless imaging member at a nip to transfer the toner image to the second member. The first and the second imaging members are each operated isothermally with at least the second member at a temperature T2 higher than the softening temperature of the toner which, in turn, is preferably above the temperature T1 of the first member.

The first member has a low surface energy, which is preferably under about 20 dynes per centimeter, and has a hard abrasion-resistant and smooth surface, while the second member is both softer and has a generally higher surface energy. When the toned image enters the nip formed by the first and second member, essentially complete image transfer to the second member occurs. The second member further has a surface energy below that of the ultimate imaging substrate, e.g., below that of paper, while its thickness and compressibility are selected to allow it to conform to this substrate. The second member forms a second nip at a pressure roller, where the image it received is transferred from the member to the substrate by contact.

In a preferred embodiment of the printing system, a charge-deposition cartridge deposits an array of charge dots on the first member to form the latent charge image, and the first member includes a dielectric surface layer which charges at each dot to a voltage level which is effective to attract and hold toner particles. For example, a five micrometer thick surface layer of Teflon PFA simultaneously provides a suitable capacitance and low surface energy. After the latent image is deposited, the first member is then developed with a toner, such as a monocomponent magnetic toner, which has preferably been formulated free of waxes or oils, with hard particulate toner particles formed of a polymer having a softening temperature somewhat below the operating temperature T2 of the second imaging member. A suitable toner is a Coates RP 1442 toner, having a particle size of 12–15 micrometers and a tack temperature of 90°–110° C. The second imaging member may be a belt having a woven Nomex carcass and a 0.5–2.0 mm overlay of the silicone rubber elastomer, operating at a temperature of 105°–120° C. The silicone rubber has a Shore A hardness of approximately 50 to 80 durometer, and is resistant to degradation or changes in its physical state so long as it is operated below about 200° C.

With these two members, when the first and second belts are each operated isothermally at 60°–65° C. and 115°–120° C., respectively, complete image transfer is achieved at speeds of 15–30 inches per second. The thickness and soft durometer of the second member increase the nip width and allow the second member to deform slightly so it conforms with the entering image, enhancing dwell in the nip and increasing the area in contact with the toned image. The first member may be maintained at a temperature below the toner aggregation temperature by a simple blower, while a heater in the second member maintains it at the temperature T2. Essentially, only a small quantity of heat enters the first member, through the first nip, so each member operates isothermally and little extraneous heat loss occurs between the members.

A final print or image is produced by transferring the hot toner image carried by the second member onto a sheet or substrate passing through a second nip. The substrate is preferably preheated to a temperature not substantially below the toner softening temperature so that when it passes through the second nip contact with toner is complete and the heated toner wicks onto the substrate, separating from the second imaging member.

BRIEF DESCRIPTION OF THE DRAWINGS

These and other features of the invention will be understood from the description and claims herein, taken together with several illustrative drawings, wherein:

DETAILED DESCRIPTION

Figure 1:
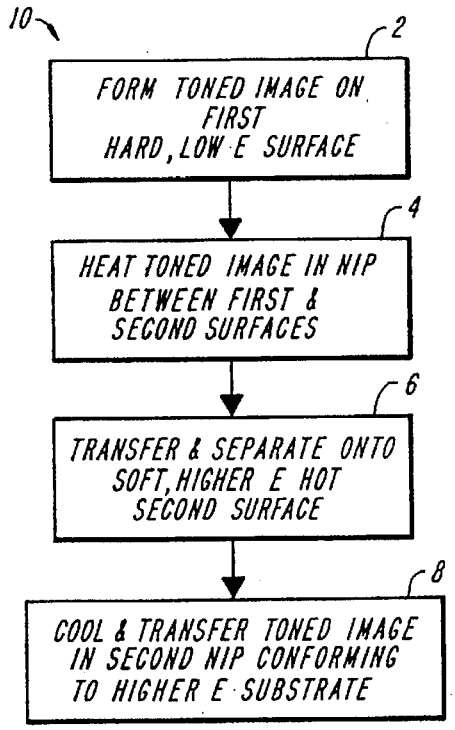
FIG. 1 illustrates steps of a basic embodiment of the method of the present invention.

FIG. 1 illustrates a printing method 10 in accordance with the present invention, which basically addresses the effective transfer of a dry toner image in an electrographic printer. The method includes a step 2 of forming a toned image on a first member which has a hard, low-energy surface, and a step 4 of heating the toned image during a short dwell time as it passes under pressure through a contact nip formed between the first member and a second member having a higher surface energy and softer bulk hardness property.

The method further includes the step 6 of separating the toned image onto the second member, by rotating the second member through the nip, each of the first and second members being maintained isothermally, with at least the second member being at a temperature above the temperature of the image in the nip. Advantageously, the second member is arranged to form a second nip through which in a second transfer step 8 a receiving substrate is passed in synchrony with passage of the heated image that was received at the first nip. The substrate is preferably preheated to a temperature somewhat below that of the second member, so that as the substrate passes a nip formed between the second member and a pressure member, the toned image undergoes a final step of sticking to the substrate and cooling.

Thus, a second or intermediate member picks up the toned image as it raises the toner temperature, and then releases it to a receiving member as it lowers the toner temperature, each of the two temperature transitions occurring near-instantaneously during dwell time of the transfer nips, while the second member runs isothermally in the middle between the first and last imaging steps.

Figure 2:
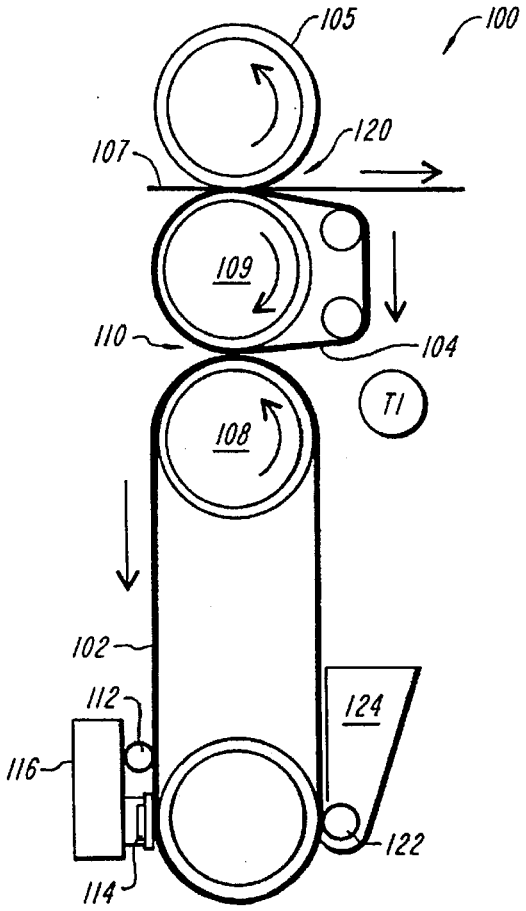
FIG. 2 is a schematic view in section of single-color printer embodying the invention.

FIG. 2 is a schematic sectional view of a complete printer 100 for performing single color printing of an image in accordance with the method of FIG. 1.

In this embodiment, a first imaging member 102, shown as a belt, receives an image and carries it to a nip 110 formed between member 102, and second member 104 which is also a belt. At nip 110, the developed toner image is transferred to the second member 104, which then carries it around to a second nip 120 formed between the member 104 and a pressure roll 105. There the image is transferred a second time, from the intermediate belt 104 to a recording substrate 107, such as a sheet of paper. Drive rolls 108, 109, move synchronously and define a precise nip where the respective belts 102, 104 contact. Similarly, pressure roll 105 may be driven synchronously with roll 109. It will be understood that one or more of the rolls may be an idler roll driven by contact with the opposing sheet, belt or drum.

In the embodiment of FIG. 2, the first imaging member 102 is a thin hard belt with a very low surface energy, and with at least a thin surface portion formed of dielectric material to receive and hold a latent charge image. Suitable belt constructions for forming such an imaging member are shown in commonly-owned U.S. Pat. Nos. 5,103,263 and 5,012,291, which are both incorporated herein by reference. The belt travels counterclockwise past a biased corona rod 112 which establishes a uniform or null level of charge on the belt surface, and continues past a charge deposition print cartridge 114. The charge disposition print cartridge is a controlled array of electrodes configured to generate localized silent glow discharge and to direct charged particles from point-like regions of the array as shown, for example in U.S. Pat. Nos. 4,160,257 and 4,992,807 and others, to the imaging belt 102. An imaging module 116 provides electronic control signals to electrodes of the print cartridge 114 in an appropriate order to deposit the desired latent image of text, graphics or the like.

Once the latent image is deposited on the first imaging member 102, it travels past a toner applicator 124 in which a magnetic brush 122 brings a thin layer of monocomponent magnetic toner into proximity with the surface of the belt causing the toner to selectively adhere to the charged areas of the latent image. The toner is formulated of hard polymer particles, free of waxes, and the member 102 is both smooth and hard, so adherence of the toner is due essentially to attraction by the latent image charge. In this manner the latent image is toned. While not illustrated, a temperature-controlled switch preferably actuates a blower to maintain a flow of room air over the inner surface of the belt or over a drive roller contacting the belt to maintain its temperature below a certain limit, e.g., about 65°–75° C.

In accordance with a principal aspect of the present invention, both belts 102 and 104 are operated isothermally, that is, each is at a constant temperature, and substantially complete transfer of the toned image is achieved due to the surface properties of the belts. To achieve this, the first member 102 has a non-elastomeric hard coating of Teflon PFA having a hardness of 65–70 Shore D, with a surface energy below about 20 dynes/cm and approximately 5 micrometers thick, resulting in a surface capacitance of about 400 pf/cm$^2$. This material allows the charge deposition cartridge to charge surface dots to a 50–250 volt potential, and maintains excellent charge dot resolution. Applicant has also successfully used a hard non-conductive silicone rubber of somewhat higher surface energy. Suitable charge deposition cartridges for latent image formation are sold, for example, by Delphax Systems, of Mississauga, Ontario, Canada. The underlying belt may be a Kapton conductive polyimide film, a stainless steel belt, or other thin continuous sheet or surface having a conductive backplane. The image-receiving belt 104, by contrast, is much thicker and has entirely different surface properties. One representative belt 104 is built with a woven Nomex body, and coated with a ½–2 mm thick layer of a silicone or fluorosilicone rubber, having a surface energy of about 22–35 dynes/cm, and a hardness in the range of approximately 50–80 Shore A. The materials are also selected so that operation at temperatures up to 200° C. will have little effect on their elastomeric, mechanical and release properties, and so that they have sufficient strength to sustain the level of strain energies occurring at the two transfer nips 110, 120.

In general, where the ultimate print is to be on plain paper, the thickness of the silicone or fluorosilicone rubber layer and its hardness are selected to assure a high degree of conformability to the receiving substrate, as described in the aforesaid U.S. Pat. Nos. 5,012,291 and 5,103,263, while thinner and/or less compressible formulations may be used for printing on or transferring to smoother substrates. The thickness also affects the effective dwell time in nip 110. Nips 110 and 120 are formed with only a moderate nip pressure, about twenty-five pounds per linear inch, and dwell times at paper feed speeds of 15–30 inches per second are in the range of 2–20 milliseconds or more. Since the thermal time constant of a ten micron toner particle is quite short, these are effective to fully heat the toner image at nip 110.

Figure 3:
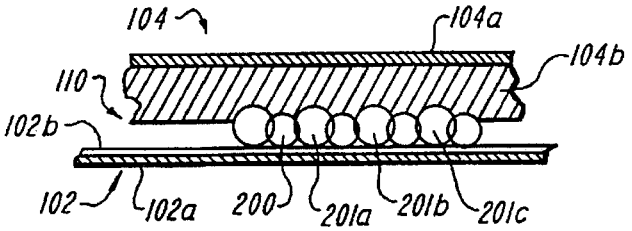
FIG. 3 shows a detail of the embodiment of FIG. 1.

FIG. 3 shows an enlarged detail of the toned image 200 passing through the nip 110 between belts 102 and 104. As shown, belt 104 has an in extensible and strong support 104*a* coated with the silicone elastomer surface layer 104*b*, while belt 102 has a much thinner dielectric surface coating 102*b* on a support formed of conductive Kapton film 102*a*, both of which are quite thin and hard.

The toner particles, which may be formed of iron oxide, lamp black and thermoplastic resin or fusible polymer, have a mean particle size ten to fifteen micrometers in diameter, and are compounded without waxes or low-temperature binders. Belts 102 and 104 are each maintained at fixed temperature, with at least belt 104 being above the toner melting temperature. By way of example, the Coates RP 1442 toner becomes tacky at 90°–110° C. and fuses at about 105° C. Belt 102 may be maintained at a relatively low temperature, below about 65° C., while running belt 104 at 120° C. allows the toner image 200 to reach an equilibrium temperature above its softening state.

As further shown in FIG. 3, in this state the toner particles do not wet the first imaging belt 102 and they present a relatively small contact area to that belt, whereas the side of the toner image contacting the hotter and softer intermediate or transfer belt 104 both wets that belt and presses into and conforms with the belt surface over a relatively larger area. Since the forces of adhesion between the toner image and a belt will generally be proportional to the area of contact as well as surface energy, the heating contact preferentially causes the toner image to adhere to the second belt 104, and image transfer is effected with essentially 100% efficiency. In related experiments conducted with another toner at room temperature, transfer efficiency was only about 80% without the benefit of the nip-softening of powdered toner. As further shown in FIG. 3, the toner particles 201 a, 201*b*, 201*c* forming the toned image 200 coalesce with neighboring particles under the influence of temperature and pressure in the nip. This renders the transferred image quite stable.

Continuing now with a description of FIGS. 2 and 3, thereafter, the belt 104 carries the received and heated toner image to the second nip 120, where it is "transfused", or simultaneously transferred to and fused on a receiving sheet as described in the aforesaid U.S. Pat. Nos. 5,012,291 and 5,103,263. The surface energy of belt 104 is less than that of sheet 107 (FIG. 2), and this, together with the "wicking" of the thermoplastic toner into the sheet promotes the complete transfer of the toned image from belt 104 onto the final recording sheet.

As noted above, belt 104 operates above the softening and melt temperatures of the toner. Sheet 107, which may for example be a sheet of twenty pound paper stock, therefore is contacted by flowable toner at the nip. In order to assure that the contact and wicking is relatively complete and is not disrupted by excessively fast cooling, sheet 107 is preferably preheated to a temperature slightly below the toner softening point, e.g., to about 85° C. for the described toner, so that its surface immediately attains a temperature in the nip which allows the toner 200 to flow or wick into the textured surface even as the toner itself undergoes a drop in temperature due to contacting the paper. In general, the surface energy of sheet 107 is above forty dynes/cm, so the toner image is preferentially held by the receiving substrate, and it will release from belt 104 and transfer to the receiving sheet as it moves through the nip.

In the described embodiment, both of the toner carrying members 102, 104 are shown as belts, but in other embodiments one or both members may be a drum or even a flat plate. A belt is preferred for the first member 102, because the contact region with the hot nip 110 may thus be more conveniently positioned away from both the cartridge 114 and the toner reservoir 124. Furthermore, a dielectric imaging belt may be made quite thin, limiting the amount of heat energy that it takes from the second transfer member, and allowing it to reach a low thermal state without using any cooling other than a small fan, as it travels around its path between imaging stations.

In general, the dwell time in the nip will depend on the belt speed, which in the prototype machines is 15–30 inches per second, on the thickness and compression of the elastomeric layer, and on the diameters and spacing of the drums or pressure rolls which define each transfer nip. These dwell times may be quite small, despite the fact that image fusing is being carried out, because the transfer processes are dependent entirely on surface to surface properties and the temperature of the thin toner layer. The characteristic thermal relaxation time for the toner particles or image is under one millisecond, so in the designs described above the toner quickly attains a temperature or changes state in the nip. In general at the process speeds described herein, the toner is believed to attain a substantially uniform temperature in the nip which is intermediate between the temperatures of the transferring member and the receiving member or sheet. Thus, very precise control over the actual temperature of the toned image in each transfer nip is obtained by simply adjusting the temperature of one donor or receiving member.

Figure 4:
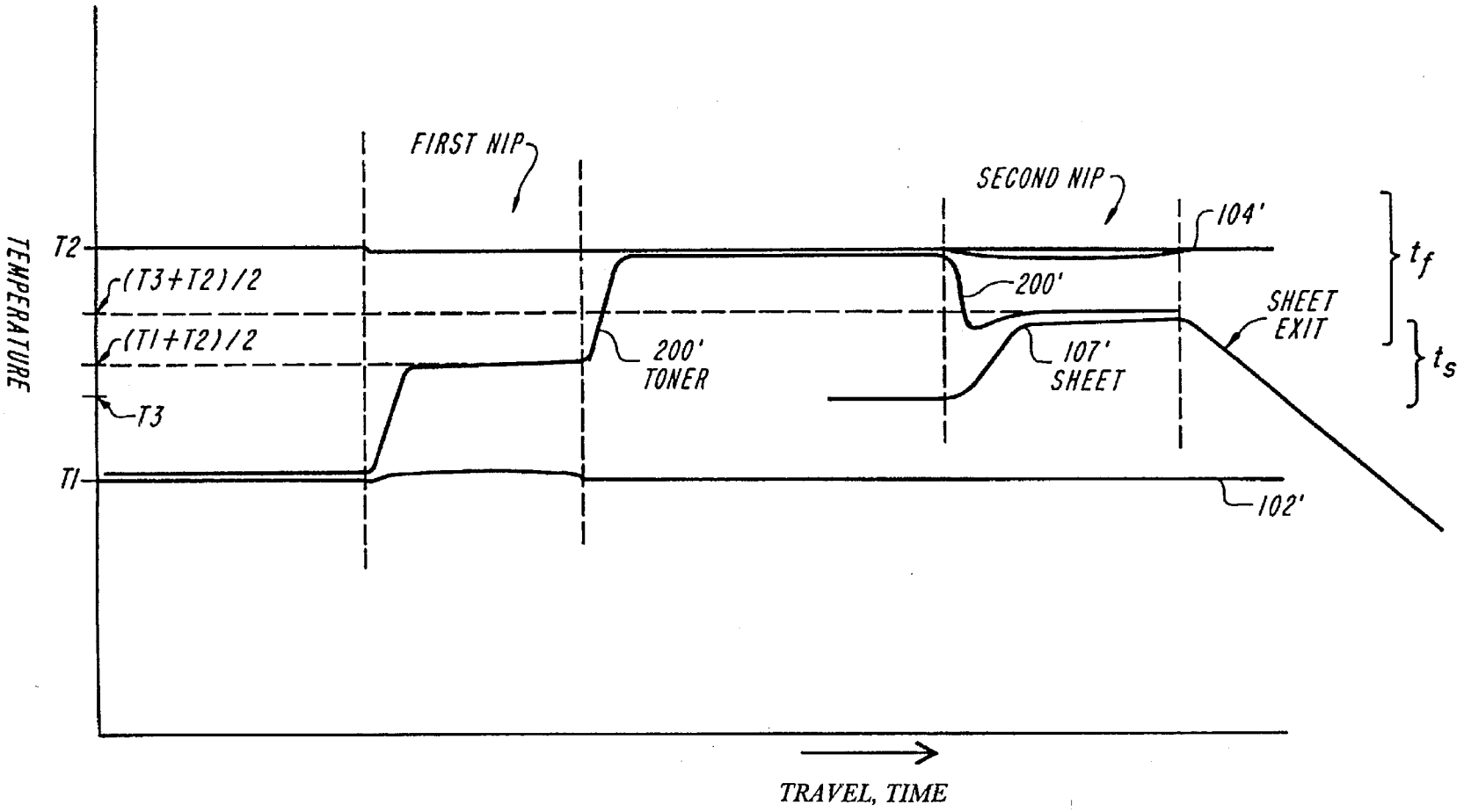
FIG. 4 illustrates temperature within the printer of FIGS. 2 and 3.

FIG. 4 illustrates, in non-dimensional units the temperatures of the various elements of the printing apparatus of FIGS. 2 and 3.

Temperature is plotted on a short time line corresponding to passage of a toned image portion through the nip, with the segment between vertical dashed lines indicating the period of nip contact. As shown by temperature curve 102', member 102 lies at a substantially uniform temperature $t_1$ which rises slightly in the nip region and quickly returns to equilibrium as the belt rotates further out of the nip. The member 104 resides at a higher temperature 104' which is generally at temperature 12, above the toner fusing temperature. This temperature drops slightly in the first nip, but remains above the toner softening temperature range $t_s$. The toner image 200 has a temperature shown by line 200'. This image is at the temperature of the belt on which it resides, and in the nip quickly rises to a temperature $(t_1+t_2)/2$ which as noted above lies above the toner softening temperature, so that under the pressure of the nip, the toner coalesces as well as adhering to the receiving member 104. At the second transfer nip, the receiving substrate 107 is fed in at a third temperature $t_3$, which, as illustrated, is lower than temperature $t_2$. In general, the image-receiving substrate will be substantially thicker than the toner image layer 200, i.e., will be 0.1 to 0.3 mm thick, and unlike the toner image will be a substantially continuous uniform sheet. Its temperature change will therefore be much slower, and only its contact surface may be expected to dependably reach a quick thermal equilibrium with an opposed member at a transfer nip. The temperature of this region is indicated by curve 107'. As the sheet passes through the nip this temperature rises to a temperature in the fusing range $t_f$ of the toner, at approximately $(t_2+t_3)/2$. After passing the nip, the temperature of the sheet falls, eventually reaching room temperature which is off of the scale of the FIGURE. In this FIGURE, the right hand portion of curve 200' corresponds to the toner on member 104 which contacts and is transferred to sheet 107. Thus the right hand portion of curve 107' is a continuation of the toner temperature curve 200', showing the evolution of the image at the second nip. As described above, this second curve may be shifted up or down by varying the temperature of the incoming sheet 107. This may be accomplished by passing sheet 107 through a radiant heater section, by applying additional heat to the sheet via pressure roll 105, or by other means known in the art.

The image transfer process has been described for illustrative purposes by reference to a printer using a single toning operation. However, in other embodiments, the invention includes multicolor or multistage printers of diverse types.

Figure 5:
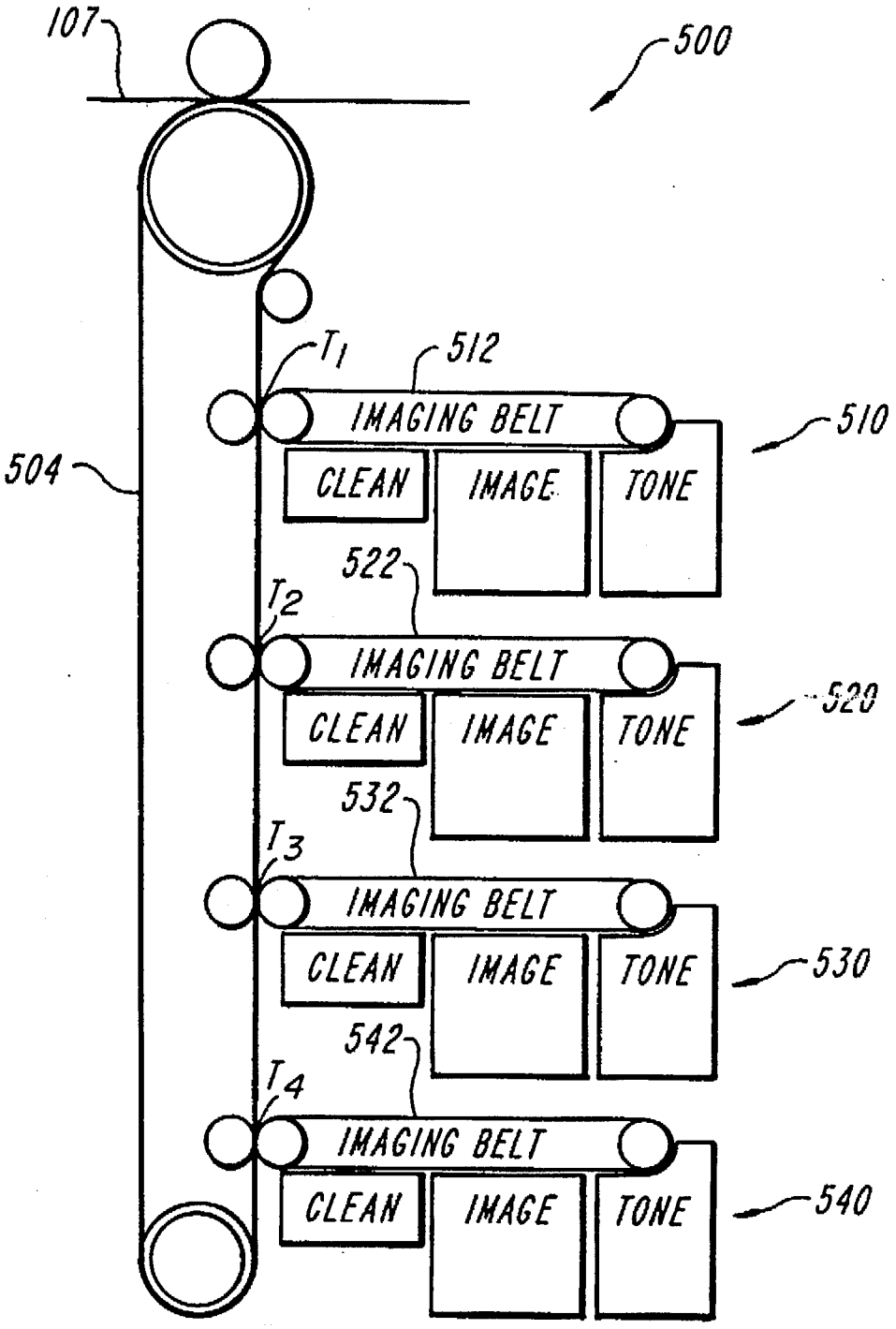
FIG. 5 illustrates a multicolor embodiment.

FIG. 5 shows a multicolor printer 500 in accordance with this aspect of the invention, in which an intermediate image transfer member 504 corresponding in function and physical characteristics to member 104 of FIG. 2 is arranged to receive a single color toned image from each of a plurality of image forming stations 510, 520, 530, 540. In each of the image forming stations an imaging member 512, 522, 532, or 542, respectively, corresponding to the member 102 of FIG. 2, receives latent charge image which is toned by a single-color toner forming a toned image. The toned images each travel to a respective transfer position $T_1$, $T_2$, $T_3$, or $T_4$ where the dry powder image is heated and relinquished to the transfer member 504. The image charging, toning and release operations of each image forming belt may be essentially the same as shown for the single color embodiment of FIG. 2. A cleaner station as indicated in the drawing may also be included between the image transfer and the erase station. Since transfer is effectively total, a simple felt wiper or cloth roller is sufficient to assure belt cleanliness.

As in the single color embodiment, both the imaging belts and the transfer belt 504 operate isothermally and at different temperatures from each other. Belt 504 has a relatively high thermal mass, and may be heated by heaters (not shown) within one or more of its transport rollers, or by radiant heaters positioned along its path. In the embodiment of FIG. 5, the image transfer from each imaging belt to the transfer member occurs at a nip defined between opposed pairs of rollers.

Figure 5A:
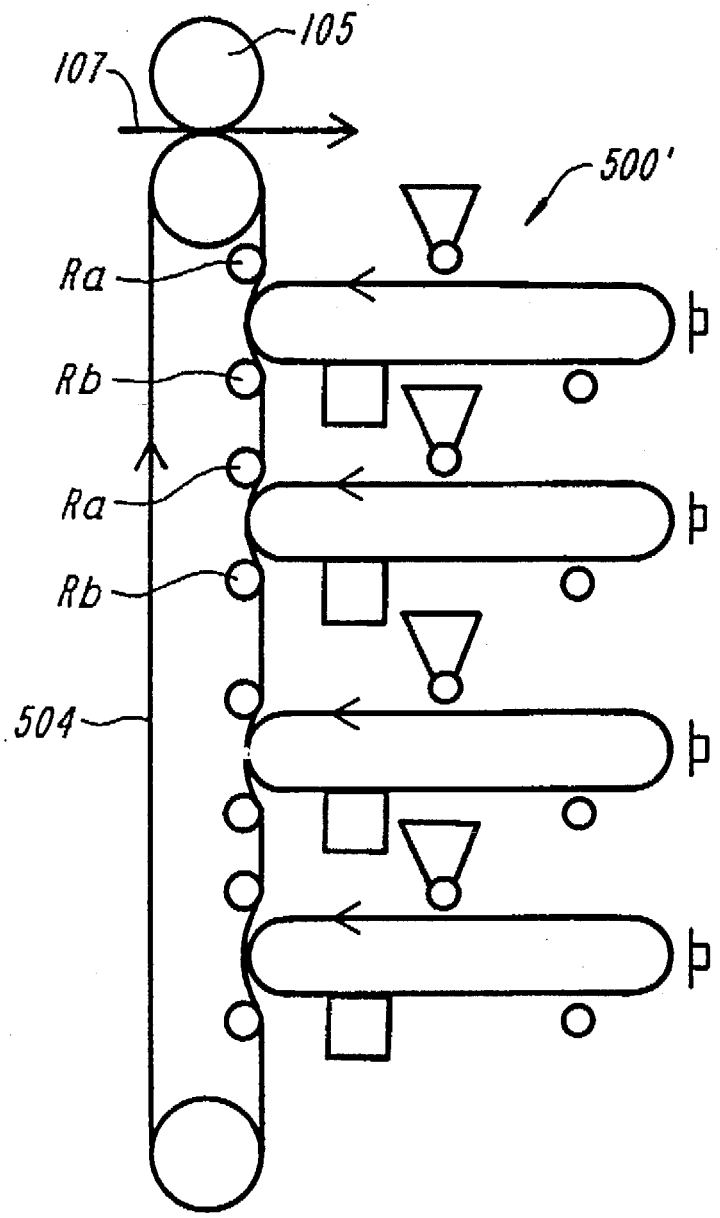
FIG. 5A illustrates another multicolor embodiment.

FIG. 5A shows another multicolor printer 500', which also utilizes a plurality of separate single color imaging stations that transfer their toned images onto a common transfer belt. Typically the four single colors may comprise three primary colors and black, with the black imaging station preferably being the last one to transfer its images—the bottom station in the illustrated system with a clockwise-moving transfer belt. In this embodiment a pair of positioning rollers, each pair simply denoted (Ra, Rb) supports the transfer belt 504 so that it runs tangentially around the circumference of the imaging belt or drum at its contact nip with each of the image-carrying members. This provides an enhanced dwell time in the nip, proportional to the length of the circumferential contact path, and allows the transfer belt 504 to operate at a lower temperature without reducing its transport speed.

The invention further contemplates that by providing the positioning rollers Ra, Rb on movable members so that their selective positions may be adjusted or varied, it is possible to separately set the dwell or contact time for the transfer belt with each of the color image carriers. This also allows the transfer belt to be retracted from contact with the imaging subsystems of one or more colors, so that the machine may be run in a single- two- or three-color mode without loss of image quality or unnecessary wear of the unused imaging belts. Registration between colors may be effected in a straightforward fashion by detection of the relative positions of each color on belt 504, and a compensating adjustment of the timing of electric control signals to the imaging cartridges in order to shift the position of a color image on each of the donor belts by an appropriate distance.

In operation, the printers of FIGS. 5 and 5A operate by forming the specific color-separation portion of a desired image separately at each of the imaging units 510, 520, 530, and 540, with phase delays or successive distance offsets along each imaging belt corresponding to the distances traveled by belt 504 between receiving successive images. After the first powder toner color image is carried to and transferred to the belt 504 where it remains as a melted image preferentially adhered to belt 504, the next color image is similarly contacted to and adhered to belt 504 on top of the already-received first image. Note that in the embodiment of FIG. 5A, the transfer belt moves synchronously in contact with the imaging belt at a very low contact pressure, and the adherence of the subsequent color to the already-deposited color will in general be at least as great as to the transfer belt, and greater than to its own low-energy imaging belt, so the additional color is released as it contacts transport 504 at a low contact force and without impairing the first color image. This process continues, with successive colors and transferred onto the existing images where they reside at the temperature T2 of the transfer belt. The combined multicolor image is then transferred to the recording sheet 107 at a pressure nip with roller 105, as in the single color embodiment.

It will be appreciated that the foregoing description is intended as illustrative only and that variations and modifications of the invention will occur to those skilled in the art, so that many practical implementations may be further varied by additional features not specifically disclosed above. For example, a release agent may be applied to one or more of the imaging belts 102, 512 . . . , or may be incorporated in one or more of the toners, to assure complete image transfer under varying conditions of speed, temperature or humidity. Similarly, the printer may be operated to heat each color toner to a different temperature, for example using different temperatures $T1_i$ for the different color imaging belts, to assure that even though the belt 504 runs isothermally, each color toner is transferred to the transfer belt at a slightly different temperature such that the first-applied toners remain unaffected by later toners.

Thus it is applicant's intention to protect the full scope of the invention and its equivalents, as defined in the claims appended hereto.

What is claimed is:

1. A printing system of the type comprising an imaging member for forming a toner image and a transfer member for receiving the toner image from the imaging member and transferring said toner image to a receiver to form a print, characterized in that the imaging member has a dielectric surface layer which is smooth, hard and has a surface energy below about 20 dynes/cm, and the transfer member has an image-receiving surface which is compressible and has a surface energy above 20 dynes/cm, said transfer member forming a transfer nip with said imaging member and operating substantially isothermally at a temperature which transforms the toner image from a solid particulate state to a cohesive flow-softened body that adheres to the transfer member in said nip.

2. A printing system according to claim 1, wherein the transfer member has a surface energy of approximately 28–30 dynes/cm and a compressibility of 50–80 Shore A.

3. A printing system according to claim 2, for use with a toner having a toner agglomeration temperature $T_{ag}$ and a toner softening temperature $T_s$ and wherein the imaging member and transfer member each operate substantially isothermally at temperatures T1 and T2, respectively, and $$T1<T_{ag}<T_s<T2.$$

4. A printing system according to claim 3, wherein the transfer member carries the toner image to a second nip at which it contacts a receiving sheet to transfer the toner image to the receiving sheet in a melted state as the temperature of the toner image decreases.

5. A printing system according to claim 4, including means for heating the receiving sheet to a temperature T3 such that $T1<T3<T_s$.

6. A printing system according to claim 1, wherein the dielectric surface layer has a capacitance above several hundred picofarads per square centimeter.

7. A printing system according to claim 1, wherein the image-receiving surface of the transfer member includes a silicone rubber.

8. A printing system according to claim 7, wherein the silicone rubber is conductive.

9. A printing system according to claim 1, wherein the image-receiving surface of the transfer member includes a fluorosilicone.

10. A printing system according to claim 1, further comprising at least one further imaging member arranged to form a toner image of an additional color and transfer the toner image of an additional color to said transfer member thereby forming a multicolor image on said transfer member.

11. A printing system according to claim 1, wherein each of said imaging member and said transfer member is a belt.

12. A printing system according to claim 1, wherein the compressible image-receiving surface of said transfer member is thicker than 0.5 millimeters.

13. A printing system according to claim 1, further comprising means for forming said toner image including latent imaging means for depositing a latent charge image directly onto said imaging member, and toning means for developing the latent charge image with a dry powder toner to form said toner image on the imaging member, said imaging member traveling successively past said latent imaging means, said toning means and said transfer nip to apply said toner image to the transfer member.

14. A printing system according to claim 13, wherein said toner is formulated without a wax component.

* * * * *